US009550228B2

(12) United States Patent
Wilcox

(10) Patent No.: US 9,550,228 B2
(45) Date of Patent: Jan. 24, 2017

(54) DUAL PISTON CLOSE CLEARANCE FASTENING TOOL

(71) Applicant: Alcoa Inc., Pittsburgh, PA (US)

(72) Inventor: Robert Wilcox, Port Ewen, NY (US)

(73) Assignee: Arconic Inc., Pittsburgh, PA (US)

( * ) Notice: Subject to any disclaimer, the term of this patent is extended or adjusted under 35 U.S.C. 154(b) by 0 days.

(21) Appl. No.: 15/074,514

(22) Filed: Mar. 18, 2016

(65) Prior Publication Data

US 2016/0271683 A1 Sep. 22, 2016

Related U.S. Application Data

(60) Provisional application No. 62/135,460, filed on Mar. 19, 2015.

(51) Int. Cl.
*B21J 15/10* (2006.01)
*B21J 15/20* (2006.01)
(Continued)

(52) U.S. Cl.
CPC ..... *B21J 15/20* (2013.01); *B21J 15/022* (2013.01); *B21J 15/043* (2013.01); *B21J 15/045* (2013.01);
(Continued)

(58) Field of Classification Search
CPC ..... B21J 15/32; B21J 15/105; B21J 15/043; B21J 15/20; B21J 15/045; B21J 15/04; B21J 15/1815; B21J 15/022; F15B 15/1404
(Continued)

(56) References Cited

U.S. PATENT DOCUMENTS 3,329,000 A * 7/1967 Schwab ..... B21J 15/022 29/243.522
5,035,353 A * 7/1991 Smart ..... B21J 15/105 227/112
(Continued)

FOREIGN PATENT DOCUMENTS

DE 317992 C 1/1920
DE 408901 C 1/1925
FR 29765 E 11/1925

OTHER PUBLICATIONS

"Twin Centre Hole Hydraulic Cylinders", http://www.sgs-engineering.com/spx-power-team/hydraulic-cylinders/centre-hole/twin, 2 pages.
(Continued)

*Primary Examiner* — David B Jones
(74) *Attorney, Agent, or Firm* — Greenberg Traurig, LLP

(57) ABSTRACT

A fastener installation tool includes a nose assembly, first and second cylinders, first and second pistons, and a yoke. The nose assembly is adapted to apply an axial load to a fastener along a longitudinal axis of the nose assembly. The first and second cylinders are diametrically opposed to one another with respect to the longitudinal axis of the nose assembly. The first piston is disposed within the first cylinder and is movable along a longitudinal axis thereof. The second piston is disposed within the second cylinder and is movable along a longitudinal axis thereof. The yoke connects the first piston, the second piston, and the nose assembly such that motion of one of the pistons along its corresponding longitudinal axis causes motion of the other one of the pistons along its corresponding longitudinal axis and motion of at least a portion of the nose assembly along its longitudinal axis.

11 Claims, 4 Drawing Sheets

(51) Int. Cl.

| | |
|---|---|
| ***B21J 15/02*** | (2006.01) |
| ***B21J 15/04*** | (2006.01) |
| ***B21J 15/18*** | (2006.01) |
| ***F15B 15/14*** | (2006.01) |
| ***B21J 15/32*** | (2006.01) |

(52) U.S. Cl.
CPC ..... *B21J 15/105* (2013.01); *B21J 15/18* (2013.01); *B21J 15/32* (2013.01); *F15B 15/1404* (2013.01)

(58) Field of Classification Search
USPC ..... 29/243.523, 243.524, 243.525
See application file for complete search history.

(56) References Cited

U.S. PATENT DOCUMENTS 5,327,639 A * 7/1994 Wing ..... B21J 15/32
29/709
6,125,680 A * 10/2000 Bradbury ..... B21J 15/043
227/112

OTHER PUBLICATIONS

International Search Report and Written Opinion dated Jul. 1, 2016, issued by the European Patent Office in International (PCT) Application No. PCT/US2016/023182 (13 pages).

* cited by examiner

DUAL PISTON CLOSE CLEARANCE FASTENING TOOL

CROSS-REFERENCE TO RELATED APPLICATION

This application is a Section 111(a) application relating to and claiming the benefit of commonly-owned, U.S. Provisional Patent Application Ser. No. 62/135,460, filed Mar. 19, 2015, entitled "DUAL PISTON CLOSE CLEARANCE FASTENING TOOL," the disclosure of which is incorporated herein by reference in its entirety.

FIELD OF THE INVENTION

The present invention relates to fastener installation tools, and, more particularly, to a dual piston, close clearance fastening tool including two pistons that are diametrically opposed to one another about a longitudinal axis of a nose assembly.

BACKGROUND OF THE INVENTION

Pull-type fasteners are commonly used for a variety of applications. In some cases, there is a need to install a pull-type fastener in a location that is relatively close to the edge of a structure to be fastened.

SUMMARY OF THE INVENTION

In an embodiment, a fastener installation tool includes a nose assembly, a first cylinder, a second cylinder, a first piston, a second piston, and a yoke. The nose assembly has a longitudinal axis and is adapted to apply an axial force to a fastener along the longitudinal axis of the nose assembly. The first cylinder has a longitudinal axis that is parallel to the longitudinal axis of the nose assembly. The second cylinder has a longitudinal axis that is parallel to the longitudinal axis of the nose assembly and is diametrically opposed to the longitudinal axis of the first cylinder about the longitudinal axis of the nose assembly. The first piston is disposed within the first cylinder and is adapted to move with respect to the first cylinder along the longitudinal axis of the first cylinder. The second piston is disposed within the second cylinder and is adapted to move with respect to the second cylinder along the longitudinal axis of the second cylinder. The yoke connects the nose assembly, the first piston, and the second piston such that motion of one of the first and second pistons along the longitudinal axis of a corresponding one of the first and second cylinders causes corresponding motion of at least a portion of the nose assembly along the longitudinal axis of the nose assembly and causes corresponding motion of another one of the first and second pistons along the longitudinal axis of a corresponding one of the first and second cylinders.

In an embodiment, the fastener installation tool also includes a housing defining the first cylinder and the second cylinder. In an embodiment, the first piston includes a pull pressure port adapted to receive a fluid pressure causing the first piston to move in a pull direction. In an embodiment, when the pull pressure port receives the fluid pressure causing the first piston to move in the pull direction, the yoke causes the second piston and the at least a portion of the nose assembly to move in the pull direction. In an embodiment, the second piston includes a return pressure port adapted to receive a fluid pressure causing the second piston to move in a return direction. In an embodiment, when the return pressure port receives the fluid pressure causing the second piston to move in the return direction, the yoke causes the first piston and the at least a portion of the nose assembly to move in the return direction.

In an embodiment, the fastener installation tool also includes a guide rod connecting the yoke to the nose assembly. In an embodiment, a pull side of the first cylinder is in fluid communication with a pull side of the second cylinder. In an embodiment, a return side of the first cylinder is in fluid communication with a return side of the second cylinder.

In an embodiment, the nose assembly includes an anvil and a collet. In an embodiment, the anvil is a swaging anvil. In an embodiment, the anvil is a stand-off anvil. In an embodiment, the collet is an integral collet. In an embodiment, the collet includes jaws. In an embodiment, the motion of at least a portion of the nose assembly includes motion of the collet with respect to the anvil. In an embodiment, the nose assembly comprises a thread adapted to engage a fastener. In an embodiment, the fastener installation tool is a hydraulic installation tool. In an embodiment, the fastener installation tool is a pneumatic installation tool.

DESCRIPTION OF THE INVENTION

Figure 2:
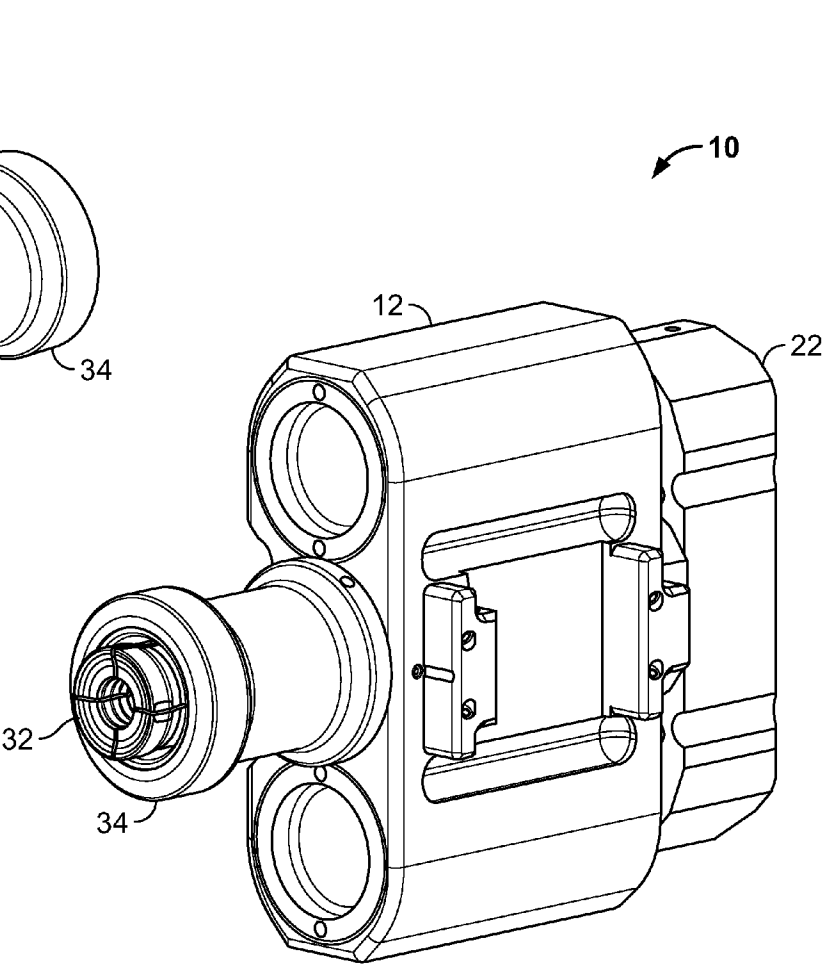
FIG. 2 is a front perspective view of the fastener installation tool shown in FIG. 1.
Figure 1:
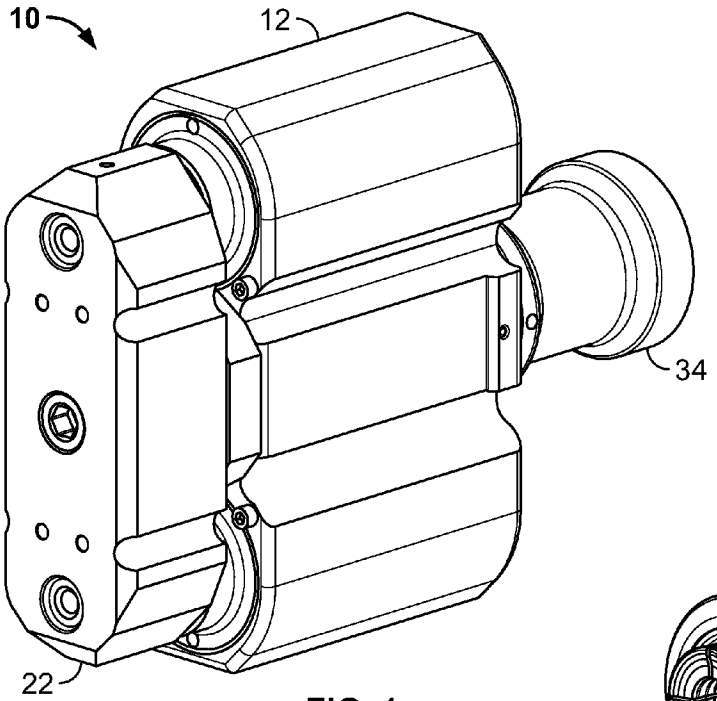
FIG. 1 is a rear perspective view of a portion of a fastener installation tool constructed in accordance with an embodiment.
Figure 4:
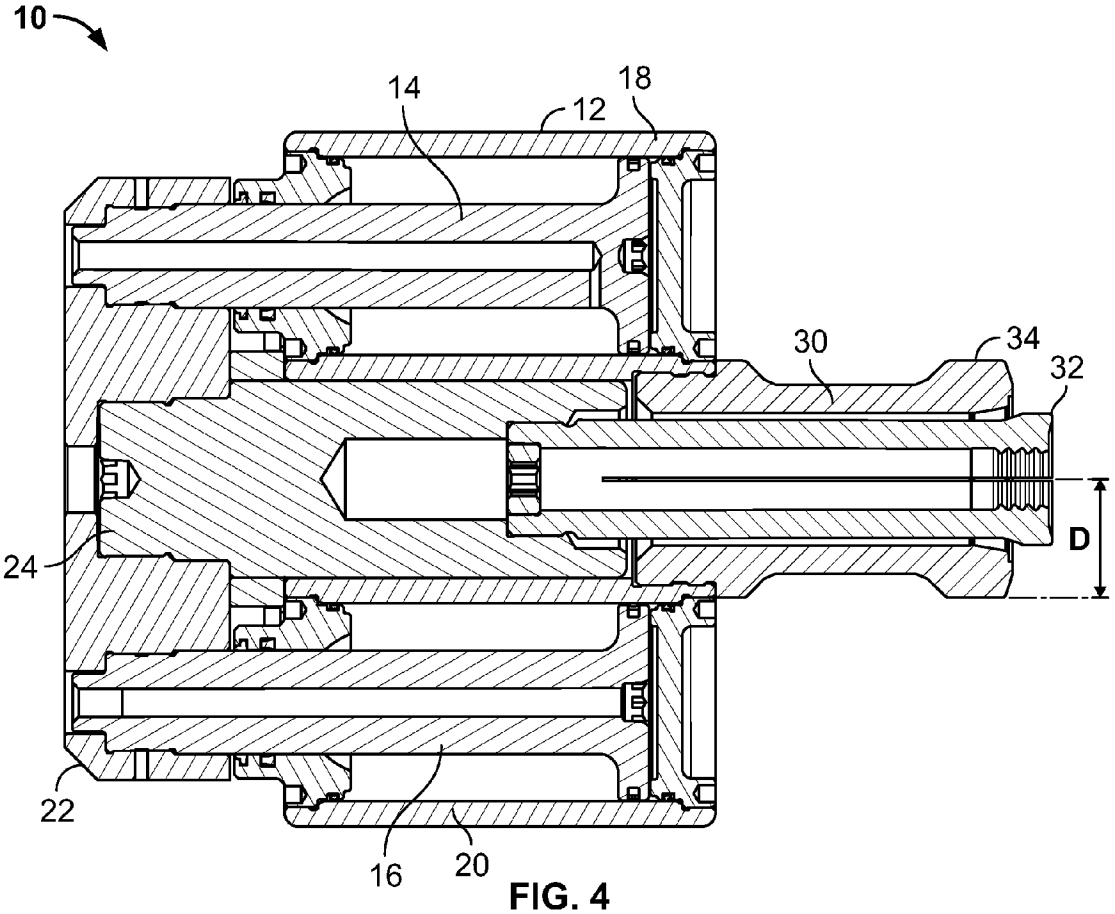
FIG. 4 is a cross-sectional view, taken along section lines A-A and looking in the direction of the arrows, of fastener installation tool shown in FIG. 3.
Figure 3:
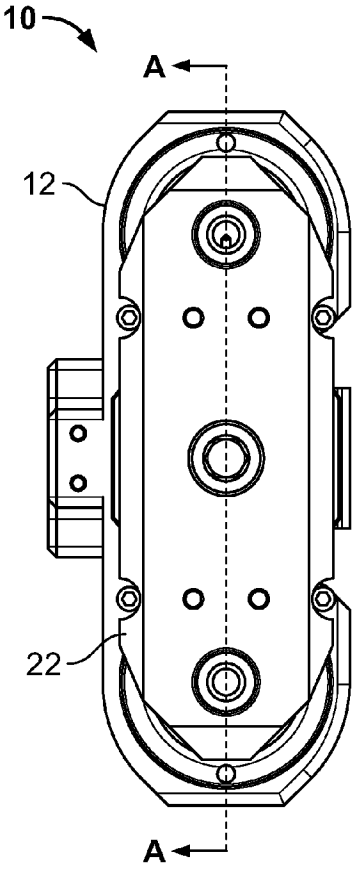
FIG. 3 is a rear elevational view of the fastener installation tool shown in FIG. 1.

FIGS. 1-4 show an embodiment of a dual cylinder fastening tool 10 for installing fasteners which require application of a pull force and/or an ejection force, such as lock bolts or blind fasteners. In an embodiment, the fastening tool 10 is a hydraulic tool. In another embodiment, the fastening tool 10 is a pneumatic tool. In an embodiment, the fastening tool 10 includes a dual cylinder housing 12. In an embodiment, the fastening tool 10 includes two pistons 14, 16 positioned slidably within cylinders 18, 20 of the housing 12, respectively, which are diametrically opposed to one another. In an embodiment, a yoke 22 connects the pistons 14, 16, and a center guide rod 24 positioned within the housing 12 and intermediate the cylinders 18, 20 such that the pistons 14, 16, the yoke 22, and the center guide rod 24 move in concert with one another.

Continuing to refer to FIGS. 1-4, in an embodiment, the piston 14 includes a pull pressure port 26 adapted to receive a fluid pressure causing the piston 14 to move in a pull direction. In an embodiment, the piston 16 includes a return or eject pressure port 28 adapted to receive a fluid pressure causing the piston 16 to move in a return or eject direction. In an embodiment, the fastening tool 10 further includes a nose assembly 30 that includes a collet 32 and a swaging anvil 34. In another embodiment, a stand-off anvil may be present in place of the swaging anvil 34. In other embodiments, the nose assembly 30 of the fastening tool 10 may include any other combination of elements adapted to apply an axial load to any type of fastener. This may include, for example, an integral collet, a collet including jaws, a threaded connection, etc.

Figure 5:
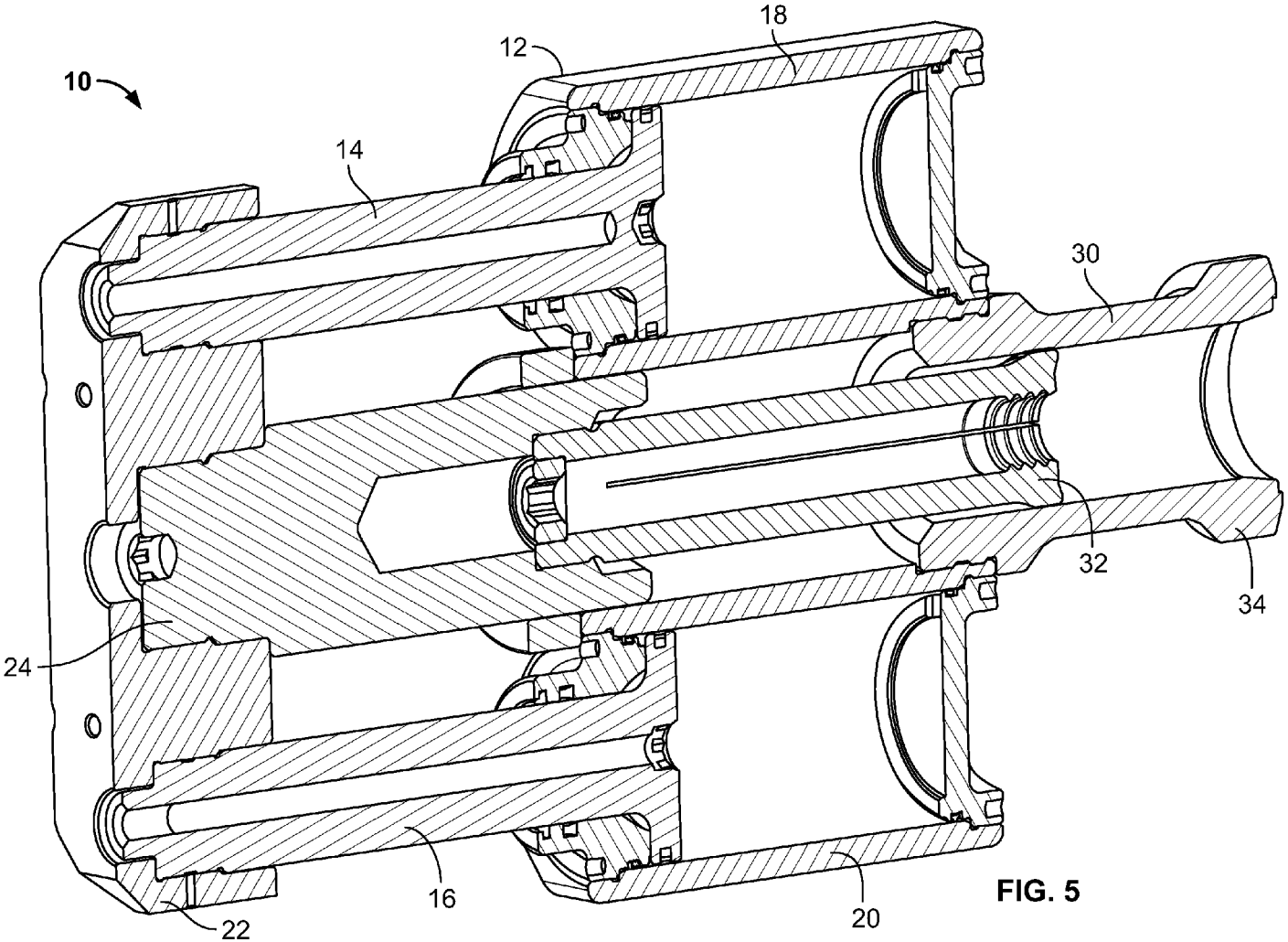
FIG. 5 is a perspective cross-sectional view of the fastener installation tool shown in FIG. 1, a collet of the fastener installation tool shown in a pull position.
Figure 6:
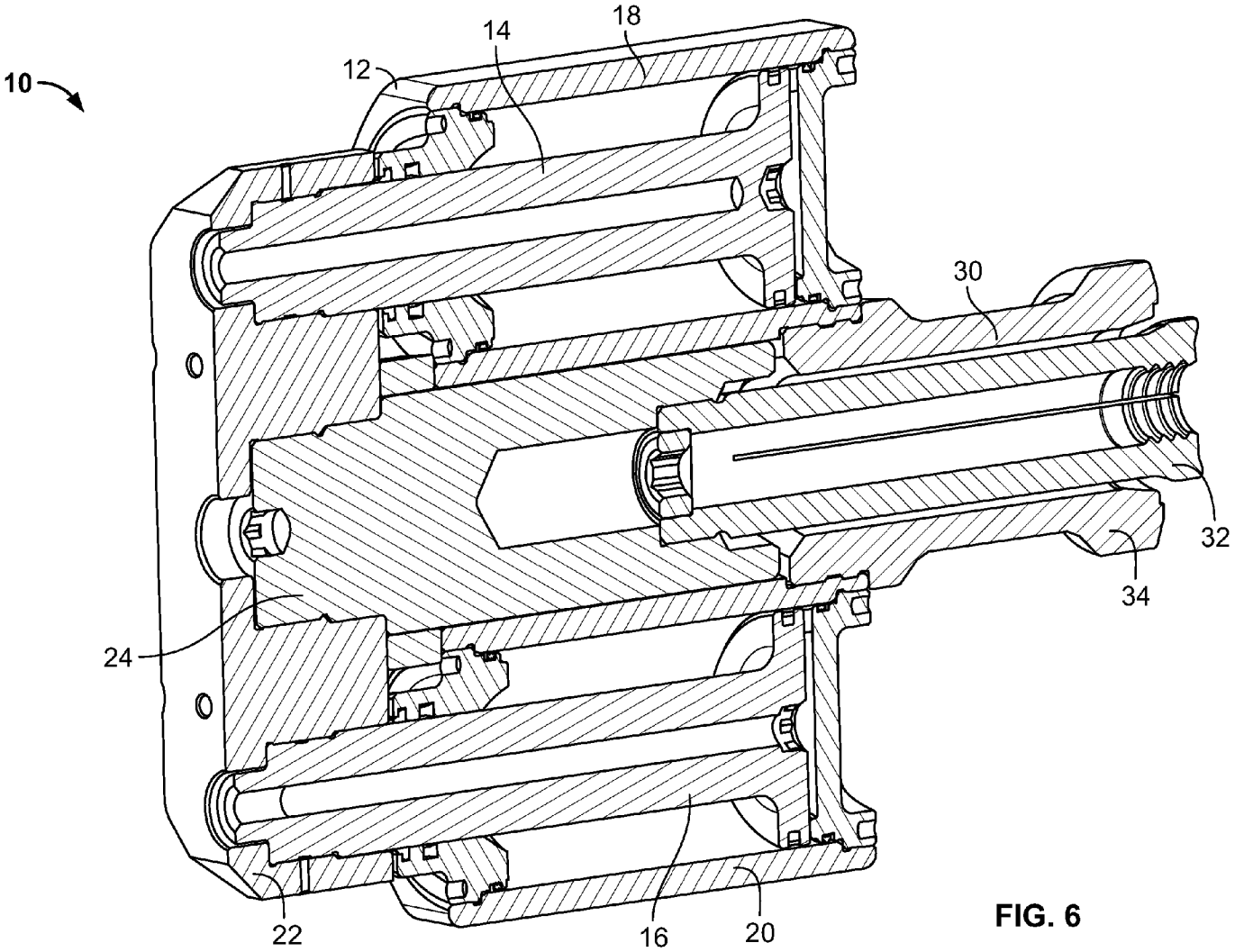
FIG. 6 is a perspective cross-sectional view of the nose assembly shown in FIG. 5, but with the collet shown in a return position.

In an embodiment, the nose assembly 30 is connected to the center guide rod 24 such that the collet 32 and the center guide rod move in concert with one another while the swaging anvil 34 remains stationary. In other words, a portion of the nose assembly 30 (i.e., the collet 32) moves axially with respect to another portion of the nose assembly 30 (i.e., the swaging anvil 34). In another embodiment, the entire nose assembly 30 may move with the center guide rod 24. In an embodiment, due to the presence of the yoke 22 connecting the pistons 14, 16 and the center guide rod 24 (and, correspondingly, the collet 32), pressure received via the pull pressure port 26 and causing the piston 14 to move in a pull direction also causes the piston 16 and the collet 32 to move in the pull direction. FIG. 5 shows the fastener installation tool 10 with the pistons 14, 16, the center guide rod 24, and the collet 32 positioned in a pull position. Similarly, in an embodiment, due to the presence of the yoke 22 connecting the pistons 14, 16 and the center guide rod 24 (and, correspondingly, the collet 32), pressure received via the return or eject pressure port 28 and causing the piston 16 to move in a return or eject direction also causes the piston 14 and the collet 32 to move in the return or eject direction. FIG. 6 shows the fastener installation tool 10 with the pistons 14, 16, the center guide rod 24, and the collet 32 positioned in a return position.

In an embodiment, the nose assembly 30 consists of a BOBTAIL® nose assembly manufactured by Alcoa Fastening Systems and disclosed in U.S. Pat. Nos. 7,921,530 and 8,621,734. In other embodiments, the nose assembly 30 can consist of a nose assembly for a C50L® lock bolt or a nose assembly for a BOM® blind bolt, both of which are manufactured by Alcoa Fastening Systems.

In an embodiment, the fastening tool 10 is adapted to meet tight clearance requirements for a centerline of a fastener to an edge of a structure. In this regard, the cylinders 18, 20, which flank the main pulling access of the nose assembly 30 in diametrically opposed positions, make it possible to reduce center-to-edge distance D (see FIG. 4) to that of the swaging anvil 34 or an outside diameter of the nose assembly 30. In addition, full use of the bore areas of the cylinders 18, 20 is rendered in the pull or swage direction where it is needed. In an embodiment, the pull side of the bore of the cylinder 18 is connected to the pull side of the bore of the cylinder 20 by one or more ports (not shown in FIG. 1) in the housing 12 such that the pull sides are in fluid communication with one another. In an embodiment, the return side (i.e., rod side) of the bore of the cylinder 18 is connected to the return side (i.e., rod side) of the bore of the cylinder 20 by one or more ports (not shown in FIG. 1) in the housing 12 such that the return sides (i.e., rod sides) are in communication with one another. In an embodiment, the pull side of the bore of the cylinder 18 is not in fluid communication with the return side of the bore of the cylinder 18. In an embodiment, the pull side of the bore of the cylinder 20 is not in fluid communication with the return side of the bore of the cylinder 20.

It should be understood that the embodiments described herein are merely exemplary in nature and that a person skilled in the art may make many variations and modifications thereto without departing from the scope of the present invention. All such variations and modifications, including those discussed above, are intended to be included within the scope of the invention.

What is claimed is:

1. A fastener installation tool, comprising:

a nose assembly including an anvil and a collet and having a longitudinal axis, said nose assembly being adapted to apply an axial force in a pull direction and in a return direction to a fastener along said longitudinal axis of said nose assembly;

a first cylinder having a pull side, a return side, and a longitudinal axis that is parallel to said longitudinal axis of said nose assembly;

a second cylinder having a pull side, a return side, and a longitudinal axis that is parallel to said longitudinal axis of said nose assembly, said longitudinal axis of said second cylinder being diametrically opposed to said longitudinal axis of said first cylinder about said longitudinal axis of said nose assembly, wherein said pull side of said first cylinder is in fluid communication with said pull side second cylinder and said return side of said first cylinder is in fluid communication with said return side of said second cylinder;

a first piston disposed within said first cylinder, said first piston being adapted to move with respect to said first cylinder along said longitudinal axis of said first cylinder;

a second piston disposed within said second cylinder, said second piston being adapted to move with respect to said second cylinder along said longitudinal axis of said second cylinder; and a yoke connecting said nose assembly, said first piston, and said second piston, such that motion of one of said first and second pistons along said longitudinal axis of a corresponding one of said first and second cylinders causes corresponding motion of at least a portion of said nose assembly along said longitudinal axis of said nose assembly and causes corresponding motion of another one of said first and second pistons along said longitudinal axis of a corresponding one of said first and second cylinders.

2. The fastener installation tool of claim 1, further comprising a housing defining said first cylinder and said second cylinder.

3. The fastener installation tool of claim 1, wherein said first piston includes a pull pressure port adapted to receive a fluid pressure causing said first piston to move in a pull direction.

4. The fastener installation tool of claim 3, wherein, when said pull pressure port receives the fluid pressure causing said first piston to move in said pull direction, said yoke causes said second piston and said at least a portion of said nose assembly to move in said pull direction.

5. The fastener installation tool of claim 4, wherein said second piston includes a return pressure port adapted to receive a fluid pressure causing said second piston to move in a return direction.

6. The fastener installation tool of claim 5, wherein, when said return pressure port receives the fluid pressure causing said second piston to move in said return direction, said yoke causes said first piston and said at least a portion of said nose assembly to move in said return direction.

7. The fastener installation tool of claim 1, further comprising a guide rod connecting said yoke to said nose assembly.

8. The fastener installation tool of claim 1, wherein said motion of at least a portion of said nose assembly comprises motion of said collet with respect to said anvil.

9. The fastener installation tool of claim 1, wherein said nose assembly comprises a thread adapted to engage a fastener.

10. The fastener installation tool of claim 1, wherein said fastener installation tool is a hydraulic installation tool.

11. The fastener installation tool of claim 1, wherein said fastener installation tool is a pneumatic installation tool.

* * * * *